US011745262B2

(12) United States Patent
Seeliger et al.

(10) Patent No.: US 11,745,262 B2
(45) Date of Patent: Sep. 5, 2023

(54) METHOD FOR FOAMING METAL IN A LIQUID BATH

(71) Applicant: POHLTEC METALFOAM GMBH, Cologne (DE)

(72) Inventors: Wolfgang Seeliger, Saarbrucken (DE); Stefan Sattler, Bornheim (DE)

(73) Assignee: POHLTEC METALFOAM GMBH, Cologne (DE)

( * ) Notice: Subject to any disclaimer, the term of this patent is extended or adjusted under 35 U.S.C. 154(b) by 555 days.

(21) Appl. No.: 16/646,770

(22) PCT Filed: Sep. 14, 2018

(86) PCT No.: PCT/EP2018/074869
§ 371 (c)(1),
(2) Date: Jun. 2, 2020

(87) PCT Pub. No.: WO2019/053184
PCT Pub. Date: Mar. 21, 2019

(65) Prior Publication Data

US 2020/0298311 A1 Sep. 24, 2020

(30) Foreign Application Priority Data

Sep. 15, 2017 (DE) ..... 10 2017 121 513.1

(51) Int. Cl.
*B22F 7/00* (2006.01)
*B22F 3/11* (2006.01)
(Continued)

(52) U.S. Cl.
CPC ..... *B22F 7/006* (2013.01); *B22F 3/1125* (2013.01); *C22C 1/08* (2013.01); *B22F 2998/10* (2013.01);
(Continued)

(58) Field of Classification Search
CPC ..... B22F 2003/1106; B22F 2003/1128; B22F 2003/1131; B22F 7/002; B22F 7/004;
(Continued)

(56) References Cited

U.S. PATENT DOCUMENTS 5,151,246 A * 9/1992 Baumeister ..... F28F 13/003 419/48
2004/0209107 A1* 10/2004 Schwingel ..... B32B 15/01 419/8
2018/0257135 A1* 9/2018 Simancik ..... B22F 3/1125

FOREIGN PATENT DOCUMENTS

BR 102012023361 A2 12/2014
DE 102010022599 B3 * 12/2011 ..... B22F 1/02
(Continued)

OTHER PUBLICATIONS

J. L. Murray and A. J. McAlister, "The Al—Si (Aluminum-Silicon) System," Bulletin of Alloy Phase Diagrams, vol. 5, No. 1, pp. 74-84, 1984. (Year: 1984).*
(Continued)

*Primary Examiner* — Vanessa T. Luk
(74) *Attorney, Agent, or Firm* — Dinsmore & Shohl LLP

(57) ABSTRACT

The invention relates to a method for producing a metal foam of at least one first metal that contains the main constituent Mg, Al, Pb, Au, Zn, Ti or Fe in a quantity of at least approximately 80 wt. % in relation to the quantity of the at least one first metal, said method comprising the following steps: (I) providing a semi-finished product comprising a foamable mixture that comprises the at least one first metal and at least one foaming agent, (II) submerging the semi-finished product in a heatable bath comprising a liquid, and (III) heating the semi-finished product in the bath in order to foam the foamable mixture by removing gas from the at least one foaming agent for forming the metal foam. The invention also relates to a metal foam, to a composite
(Continued)

material that can be obtained by the method, and to a component comprising the metal foam and/or the composite material.

21 Claims, 1 Drawing Sheet

(51) Int. Cl.
*C22C 1/08* (2006.01)
*C22C 1/04* (2023.01)

(52) U.S. Cl.
CPC ..... *C22C 1/0416* (2013.01); *C22C 1/0458* (2013.01); *C22C 1/083* (2023.01)

(58) Field of Classification Search
CPC .. B22F 7/006; B22F 7/008; B22F 7/02; B22F 7/04; B22F 2007/042; B22F 2007/045; B22F 2007/047; B22F 2202/15
See application file for complete search history.

(56) References Cited

FOREIGN PATENT DOCUMENTS

| | | | | |
|---|---|---|---|---|
| EP | 0927591 | A2 | 7/1999 | |
| EP | 3135404 | A1 | 3/2017 | |
| JP | 2004535516 | A | 11/2004 | |
| KR | 940007942 | Y1 | 4/1992 | |
| WO | WO-2017037522 | A1 * | 3/2017 | ..... B22C 9/06 |

OTHER PUBLICATIONS

Banhart et al., Recent Trends In Aluminum Foam Sandwich Technology, Advanced Engineering Materials., Bd. 15, Nr. 12,1, Dec. 2012 (Dec. 1, 2012), pp. 1082-1087, XP055524309, Germany, ISSN: 1438-1656, DOI: 10.1002/adem.201100333.
Banhart et al., Aluminum Foam Sandwich Panels: Manufacture, Metallurgy and Applications, Advanced Engineering Materials., Bd. 10, Nr. 9, Sep. 1, 2008 (Sep. 1, 2008), pp. 793-802, XP055524314, DE, ISSN: 1438-1656, DOI: 10.1002/adem.200800091.
Kingsley et al., Deveopment Of Laboratory-Scale Salt Bath Furnace, Innovative Systems Design And Entineering, ISSN 2222-1727 (Paper) ISSN 2222-2871 (Online), vol. 5, No. 8, 2014, pp. 16-22.
Han Goon Kim et al, "Fluidized Bed Furnace: Challenges for the Next Century", Journal of the Korean society for heat treatment, vol. 12, No. 4 pp. 345-352, 1999.

* cited by examiner

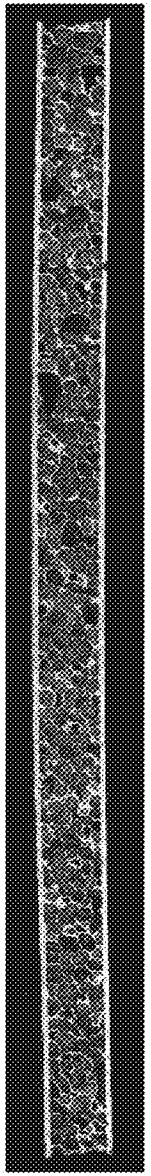

METHOD FOR FOAMING METAL IN A LIQUID BATH

The invention relates to a method for producing a metal foam of at least one first metal that contains the main constituent Mg, Al, Pb, Au, Zn, Ti or Fe in a quantity of at least approximately 80 wt. % in relation to the quantity of the at least one first metal, said method comprising the following steps: (I) providing a semi-finished product comprising a foamable mixture that comprises the at least one first metal and at least one foaming agent, (II) submerging the semi-finished product in a heatable bath comprising a liquid, and (III) heating the semi-finished product in the bath in order to foam the foamable mixture by removing gas from the at least one foaming agent for forming the metal foam. The invention also relates to a metal foam, to a composite material that can be obtained by the method, and to a component comprising the metal foam and/or the composite material.

Metal foams and composite materials comprising metal foams, such as metal foam sandwiches, have been known for years. They are of especial interest if the composite is a single-substance system, in other words if a particular metal and alloys thereof are used, in particular aluminum and alloys thereof, and the connection between the core and the cover layer is produced by a metallurgical connection. Corresponding methods for producing metal foams and composite materials of this type and components manufactured therefrom are known from various publications. DE 44 26 627 C2 describes a method in which one or more metal powders are mixed with one or more blowing agent powders, and the resulting powder mixture is compressed by axial hot pressing, hot hydrostatic pressing or rolling, and in a subsequent operation combined with previously surface-treated metal sheets by roll-cladding to form a composite material. After the resulting semi-finished product is shaped, for example by pressing, deep-drawing or bending, in a final step it is heated to a temperature in the solidus/liquidus range of the metal powder but below the melting point of the cover layers. Since the blowing agent powder is selected in such a way that gas separation thereof simultaneously occurs in this temperature range, bubbles thus form within the viscous core layer, this being accompanied by a corresponding increase in volume. The subsequent cooling of the composite stabilizes the foamed core layer.

In a modification to the method known from DE 44 26 627 C2, in which the powder pellet is already formed closed-pore, EP 1 000 690 A2 describes the manufacture of a composite material of this type on the basis of a powder pellet that is initially formed open-pore and only becomes closed-pore during the subsequent roll-cladding with the cover layers. The original open-pore nature is intended to prevent any gas separation of the blowing agent powder leading to changes in shape in the pellet during storage and thus to problems in the subsequent production of the composite comprising the cover layers. Further, the open-pore nature is intended to facilitate breakup, during production of the composite, of the oxide layers that form during the storage of the pellet.

DE 41 24 591 C1 discloses a method for producing foamed composite materials, the powder mixture being filled into a hollow metal profile and subsequently rolled together therewith. The shaping of the resulting semi-finished product and the subsequent foaming process take place in the same manner described in DE 44 26 627 02.

EP 0 997 215 A2 discloses a method for producing a metal composite material, consisting of solid metal cover layers and a closed-pore, metal core, said method combining the production of the core layer and the connection to the cover layers in one step in that the powder mixture is introduced into the roll gap between the two cover layers and thus compressed between them. It is further proposed to supply the powder in a protective gas atmosphere, so as to suppress the formation of oxide layers that could negatively influence the required connection between the cover layers and the powder mixture.

In a further method, known from DE 197 53 658 A1, for producing a composite material of this type, the process steps of composite production between the core and the cover layers, on the one hand, and foaming, on the other hand, are combined in that the core is introduced in the form of a powder pellet between the cover layers located in a mold and is only connected thereto by way of the foaming process. As a result of the compressive force applied during the foaming of the core, the cover layers are thus simultaneously subjected to a deformation corresponding to the mold enclosing them.

U.S. Pat. No. 5,972,521 A discloses a method for producing a composite material blank in which air and moisture are removed from the powder by evacuation. Subsequently, the evacuated air is replaced with a gas under elevated pressure that is inert toward the core material, specifically before the powder is compressed and connected to the cover layers. EP 1 423 222 discloses a method for producing a composite from composite layers and metal powder in which the entire production process takes place under vacuum. Especially the compression of the powder bulk and the subsequent rolling should take place under vacuum.

It is common to all of these methods known in the art, except for that of EP 1 423 222, that the production of the core layer to be foamed results in air or protective gas being included between the metal powder particles during compaction and being compressed as a function of the compaction level. The resulting gas pressures, which rise even further during the increase in temperature during the foaming process, lead to formation of pores during heating even before the temperature corresponding to the solidus/liquidus range of the metal powder material is reached. By contrast with the closed, spherical pores sought with these methods, which occur as a result of gas evolution from the blowing agent powder in the solidus/liquidus range of the metal powder, these are open, irregularly shaped pores that are interconnected in the form of cracks. Whereas U.S. Pat. No. 5,564,064 A1, for example, discloses a method that selectively seeks an open-pore nature of this type through expansion of included gases below the melt temperature of the powder material, in the methods described above pore formation of this type is not desirable, since only the sought closed, spherical pores make optimum load transmission possible via the cell walls, which are as intact as possible, enclosing the pores, and thus contribute significantly to the strength of the core foams and thus of the composite material.

DE 102 15 086 A1 discloses a method for producing foamable metal bodies by compacting and pre-compressing a semi-finished product. The gas-removing blowing agent is only formed after the compaction and pre-compression of the semi-finished product, by hydration of the mixture of metal-containing blowing agent primary material and the at least one metal. The porous metal body is formed by heating the foamable metal body thus obtained to a temperature above the decomposition temperature of the blowing agent, it being preferred for this to take place immediately after the production of the foamable metal body without intermediate cooling thereof.

BR 10 2012 023361 A2 discloses the production of a closed-pore metal foam, in which a semi-finished product, which contains a metal, selected from the group consisting of Al, Zn, Mg, Ti, Fe, Cu and Ni, and a blowing agent, selected from the group consisting of $TiH_2$, $CaCO_3$, $K_2CO_3$, $MgH_2$, $ZrH_2$, $CaH_2$, $SrH_2$ and $HfH_2$, among others, is foamed in a resistance furnace preheated to 780° C. WO 2007/014559 A1 discloses a method for production of metal foam by powder metallurgy, in which a pressed semi-finished product is used, which is heated in a chamber, which can be sealed in a pressure-tight manner, to the melting point or solidus temperature of the powdered metal material, after the reaching of which the pressure in the chamber is reduced from an initial pressure to a final pressure in such a way that the semi-finished product foams up.

DE 199 33 870 C1 proposes a method for producing a metal composite material body using a foamable pellet, wherein the pellet or the semi-finished product is produced by compressing a mixture of at least one metal powder and at least one gas-removing blowing agent powder. The pellet is then thermally treated together with an armoring in a foaming mold, and thus foamed.

In U.S. Pat. No. 6,391,250, a foamable semi-finished product, which is obtained by powder metallurgy production methods and contains at least one functional structural element, is foamed in a hollow mold while heating. US 2004/0081571 A1 relates to a method for producing foamable metal chips, which contain a mixture of a metal alloy powder with a foaming agent powder or blowing agent powder and which are foamed by heating to a temperature greater than the decomposition temperature of the foaming agent. EP 0 945 197 A1 discloses a method in which composite metal sheets or bands, produced from plated rolling ingot formats, are shaped from a blowing-agent-containing aluminum alloy, and subsequently foamed to the ignition temperature of the blowing agent while increasing pressure and temperature.

DE 199 08 867 A1 discloses a method for producing a composite body, in which a metal foam material is foamed by powder metallurgy, while supplying heat to a first body part in such a way that the outer substance layers melt on the connecting faces of a substrate body and are thus connected to the adjacent substance layers of the first body part by substance metallurgy.

The foaming methods known in the art propose heating the relevant precursor material (semi-finished product) for foaming. For this purpose, although in some case particular heat sources such as a resistance furnace are proposed, either there is no statement made as regards the exact type of heat transmission from the heat source to the semi-finished product, or the heat transmission takes place substantially or exclusively indirectly, via an air-filled gap between the heating source and the semi-finished product, in other words without direct contact between heating source and semi-finished product, but rather by radiation, with resulting heat losses. This has the drawback of transmission that is not homogenous, and does not take place uniformly over the entire surface, of the heat required for foaming to the precursor material or semi-finished product to be foamed. Different regions of the semi-finished product are thus heated differently, leading to the foaming temperature being reached and thus leading to gas development from the blowing agent at various points in the semi-finished product at different times in each case. This results in normal foam formation at the points where the foam temperature is reached while there is still no foam formation taking place at other points. In the regions between the points with normal foam formation and those without foam formation, flaws thus inevitably occur, such as warpages, dents, bubbles, bulges and cavities, which do not correspond to the (intended) pores in the normally foamed regions. In particular, these faults in the intermediate regions result in unintended and undesired twisting and distortion of the semi-finished product as a whole, making it difficult or impossible to insert the foamed products in components requiring precise manufacture, for example in vehicle and aircraft construction. Finally, many known foaming methods comprise additional steps, such as preparing and using (hollow) molds or applying pressure or negative pressure to the semi-finished product, and are thus too expensive to carry out.

Thus, the object of the invention is to provide an improved method for foaming metal, which is suitable for overcoming the aforementioned drawbacks and thus, with as few process steps as possible, producing a virtually error-free metal foam or composite material comprising metal foam of this type.

Surprisingly, it has been found that foamable mixtures of metal and blowing agent, in particular in the form of semi-finished products, can be foamed in a correspondingly heated liquid bath so as to form a metal foam. In this case, surprisingly, complete wetting of the outer surface of the region to be foamed, but generally—partly so as to further simplify the method—complete wetting of the outer surface of the entire semi-finished product with the heated fluid may take place, without the wetting with liquid having negative effects on the structure and quality of the semi-finished product and the forming metal foam. Although no additional pressure or negative pressure is exerted on the surface of the semi-finished product from the outside, as would be the case for other methods and the molds and/or presses used therein, during the foaming process using a liquid bath, faults, for example warpages, dents, bubbles, bulges and cavities, which do not correspond to the (intended) pores in the normally foamed regions, surprisingly do not occur. In particular, no (intermediate) regions comprising warpages and bubbles are observed, and so twisting and deformation of the semi-finished product as a whole remains absent. Since the semi-finished products thus do not have to be held individually in a mold and/or press and subjected to a particular contact pressure, so as to ensure a uniform heat transition, a plurality of semi-finished products can be foamed simultaneously in a liquid bath. In particular, when the metal foaming process according to the invention is carried out, no protective gas is required; according to the invention, it is possible to work in the ambient atmosphere or an air atmosphere at ambient air pressure.

In this way, surprisingly, a much larger number of semi-finished products can be foamed per unit time than for the described conventional procedures, in which for example additional time expenditure is required for opening and closing a mold or press and building up pressure therein. Thus, according to the invention, a higher throughput is achievable along with a simultaneously improvement in the quality of the metal foams.

The present invention therefore provides:

(1) a method for producing a metal foam of at least one first metal that contains the main constituent Mg, Al, Pb, Au, Zn, Ti or Fe in a quantity of at least approximately 80 wt. % in relation to the quantity of the at least one first metal, said method comprising the following steps:

(I) providing a semi-finished product comprising a foamable mixture that comprises the at least one first metal and at least one foaming agent, (II) submerging the semi-finished product in a heatable bath comprising a liquid, and (III) heating the semi-finished product in the bath in order to foam the foamable mixture by removing gas from the at least one foaming agent for forming the metal foam, and to a component comprising the metal foam and/or the composite material.

(2) a method as defined in (1) above, wherein the semi-finished product comprises at least one first region, which is formed from the foamable mixture, and at least one second region, which is formed from the at least one second metal in the form of non-foamable full material, for producing a composite material, the composite material comprising at least one first region, which is formed from the metal foam of the at least one first metal, and at least one second region, which is formed from at least one second metal in the form of non-foamable full material;

(3) a composite material comprising a metal foam that can be obtained by a method as defined in (2) above; and (4) a component comprising a composite material that can be obtained as defined in (3).

If "approximately" or "substantially" is used in relation to values or value ranges in the context of the invention, or if particular values are apparent from the context when these terms are used (for example the wording "the gas evolution temperature of A is approximately equal to the solidus temperature of B" may be understood as a particular temperature that is apparent to a person skilled in the art from the material B used), this should be understood to mean whatever a person skilled in the art would considered conventional in the field in the given context. In particular, the terms "approximately" and "substantially" comprise deviations of the specified values by ±10%, preferably of ±5%, more preferably of ±2%, particularly preferably of ±1%.

The invention thus relates to a method for producing a metal foam or a metal composite material containing a metal foam. According to the invention, the metal foam and the metal foam in the composite material comprise or consist of at least one first metal, which forms cavities in the form of pores, preferably in the form of closed pores, which contain a gas (gas inclusions), which may consist of air, the gas released from the at least one blowing agent, or mixtures thereof. Exactly one first metal is preferred. The at least one first metal is foamed using a blowing agent. In this context, the volume of the first metal increases as a result of the pore formation or gas inclusions. For the foaming process, a mixture of the at least one first metal and the at least one blowing agent is produced in the form of a foamable mixture. This foamable mixture is preferably in the form of or part of a semi-finished product. The foamable mixture or the semi-finished product is submerged in a heatable bath (heating bath) to foam the at least one first metal or the foamable mixture. Heating the heating bath leads to release of a gas (gas removal) from the at least one first metal, by producing pores in the at least one first metal and thus producing the metal foam. The submersion (II) and heating (III) steps may take place simultaneously, within the meaning that the semi-finished product is submerged in a warmed or heated bath.

Herein, the term "metal" is understood to include both a metal in the commercially conventional pure form ("pure metal" such as pure magnesium, pure aluminum, pure iron, pure gold etc.) and alloys thereof.

As a first metal, according to the invention, in principle all foamable metals are suitable, in pure form or as an alloy. Metals in pure form (pure metals) contain the metal in question in a quantity or at a content of at least 99 wt. %, in relation to the metal in question. Suitable foamable metals are in particular magnesium (Mg), aluminum (Al) lead (Pb), gold (Au), zinc (Zn), titanium (Ti) or iron (Fe). The first metal may thus be magnesium (Mg), aluminum (Al), lead (Pb), gold (Au), zinc (Zn), titanium (Ti) or iron (Fe) in pure form, in other words, pure magnesium, pure aluminum, pure lead, pure gold, pure zinc, pure titanium or pure iron, the content of the metal in question preferably being at least 99 wt. %, in relation to the metal in question. However, as a first metal, according to the invention, a metal is also suitable in which magnesium (Mg), aluminum (Al), lead (Pb), gold (Au), zinc (Zn), titanium (Ti) or iron (Fe) forms the main constituent, in a quantity of at least 80 wt. % (percent by weight, % by weight), in relation to the quantity of the first metal. Therefore, alloys of the aforementioned metals are also used. Therefore, as well as the pure metal, the term "metal" according to the invention also includes metal alloys or, in short, alloys. For example, a suitable alloy of magnesium is AZ 31 (Mg96Al3Zn). Suitable alloys of aluminum are for example selected from the group consisting of:

high-strength aluminum alloys selected from the group consisting of aluminum-magnesium-silicon alloys (6000 series) and aluminum-zinc alloys (7000 series), AlZn4.5Mg (alloy 7020) being particularly preferred among the aluminum-zinc alloys, and high-strength aluminum alloys having a melting point of approximately 500° C. to approximately 580° C., preferably high-strength aluminum alloys having a melting point of approximately 500° C. to approximately 580° C., that comprise aluminum, magnesium and silicon, more preferably AlSi6Cu7.5, AlMg6Si6 and AlMg4(±1)Si8(±1), even more preferably AlMg6Si6 and AlMg4(±1)Si8(±1), particularly preferably AlMg4(±1)Si8(±1).

The at least one first metal may be aluminum or pure aluminum (at least 99 wt. % aluminum), aluminum being preferred in which the aluminum content is from approximately 80 wt. % to approximately 90 wt. %, particularly preferably approximately 83 wt. %, in relation to the at least one first metal. In addition, the at least one first metal may be a high-strength aluminum alloy. The high-strength aluminum alloy may be selected from the group consisting of aluminum-magnesium-silicon alloys (6000 series) and aluminum-zinc alloys (7000 series), AlZn4.5Mg (alloy 7020) being preferred among the aluminum-zinc alloys (7000 series). The at least one first metal may thus in particular be AlZn4.5Mg (alloy 7020). The at least one first metal may be a high-strength aluminum alloy having a melting point of approximately 500° C. to approximately 580° C.; preferred high-strength aluminum alloys are AlSi6Cu7.5, AlMg6Si6 and AlMg4(±1)Si8(±1). The at least one first metal may also be a high-strength aluminum alloy having a melting point of approximately 500° C. to approximately 580° C. that comprises aluminum, magnesium and silicon or is exclusively composed of these chemical elements. Preferred high-strength aluminum alloys having a melting point of approximately 500° C. to approximately 580° C. that comprise aluminum, magnesium and silicon are AlMg6Si6 and AlMg4(±1)Si8(±1), of which AlMg4(±1)Si8(±1) is particularly preferred.

The designations "series" and "alloy" followed by a four-digit number are designations routine to a person skilled in the art for particular classes or series of aluminum alloys or a fully specified aluminum alloy, as specified in herein.

The specification (±1) in the alloy formulae used herein means that, of each relevant chemical element, a percentage by mass may also be more or less than specified. In general, however, there is an interrelation between two elements provided with specifications of this type in a formula; in other words, if for example one percent by mass more of the first element provided with (±1) in the formula is present, one percent by mass less of the second element provided with (±1) in the formula is present. The formula AlMg4(±1)Si8(±1) thus, among other things, also comprises the formulae AlMg5Si7 and AlMg3Si9.

A suitable alloy of lead is for example the lead-copper alloy comprising approximately 1% copper, in other words PbCu1 or PbCu. Suitable alloys of gold are for example gold-titanium alloys comprising approximately 1% titanium, in other words AuTi1 or AuTi. Suitable alloys of zinc are for example zinc-titanium alloys comprising approximately 1% to 3% titanium, for example ZnTi1, ZnTi2 or ZnTi3. A suitable alloy of titanium is for example Ti-6Al-2Sn-4Zr-6Mo.

Suitable alloys of iron are in particular steel. According to the invention and pursuant to DIN EN 10020:2000-07, "steel" designates a material in which the mass proportion of iron is greater than that of any other element, in which the carbon content is generally less than 2%, and which contains other elements. A limited number of chromium steels may contain more than 2% carbon, but 2% is the usual boundary between steel and cast iron.

Within the meaning of the present invention, a semi-finished product is a foamable primary material that after foaming results in a metal foam or a composite material comprising a metal foam of this type. For this purpose, the semi-finished product, as a precursor to the metal foam, comprises or exclusively includes a foamable mixture. The foamable mixture comprises the metal to be foamed, in other words the at least one first metal, at least one blowing agent and optionally at least one additive. The foamable mixture or the entire semi-finished product may be produced by powder metallurgy approaches. Semi-finished products produced by powder metallurgy have the foamable mixture as a pressed-together powder in the form of a pellet (powder pellet) or in a form compressed in such a way that the mixture can be rolled, for example as rollable ingots (rolling ingots). The foamable mixture may also be present as a solid metal that has absorbed a gaseous blowing agent such as hydrogen gas. According to the invention, however, all semi-finished products that are known to a person skilled in the art and foamable into a metal foam may be used. During foaming to form the metal foam, this naturally being associated with an increase in volume of the semi-finished product or the metal structure of the at least one first metal therein, these foamable semi-finished products have to be able to expand accordingly.

Within the meaning of the present invention, a composite material is a metal material in which two structurally different materials, specifically foamed metal (metal foam) and metal in the form of a solid, non-foamable full material are combined together and interconnected in a positive and/or material fit. The (final) connection by substance metallurgy between the metal foam and the metal full material takes place on the adjacent connecting faces thereof by melting these during foaming of the foamable mixture while supplying heat. However, the majority of the metallurgical connection between the foamable mixture and the full material is already present in the semi-finished product; for example, by shaping the foamable mixture or core and the cover layers, oxide-free surfaces can be produced, which lead to the powder particles of the foamable mixture and the solid full material (of the cover layer(s)) being interconnected; in other words, a type of welding occurs.

The composite material according to the invention comprises a metal foam and metal in the form of non-foamable, solid full material. For this purpose, the composite material comprises or has at least one first region, which is formed from the metal foam of the at least one first metal or comprises this metal foam, and at least one second region, which is formed from or comprises at least one second metal in the form of non-foamable full material. Preferably, the at least one second region comprises or has exactly one second metal in the form of non-foamable full material. The at least one second region may in particular be formed as a solid, non-foamable metal layer, particularly as a cover layer, on at least part of the surface of the at least one first region. Preferably, on the surface of the first region, two second regions are applied, each as a layer, in particular cover layer, in the form of non-foamable full material, in other words two solid layers. The two solid (cover) layers are preferably separated from one another by a zone of the first region, in such a way that, during foaming, the first region could expand as a result of the associated increase in volume due to the formation of the metal foam in this zone. Preferably, the composite material has exactly one first region and exactly one second region. For particular applications, the composite material preferably has exactly one first region and exactly two second regions. Particularly preferably, the composite material has exactly one first region and exactly two second regions, each of the two second regions forming a layer on the first region. Most preferably, the two second regions or layers are separated by a zone in which the first region or the semi-finished product could expand during foaming.

The semi-finished product, as a precursor for the composite material or for producing the composite material within the meaning of the present invention, is a foamable primary material that results in the composite material after foaming. For this purpose, the semi-finished product comprises or has at least one first region, which is formed from or comprises the foamable mixture, and at least one second region, which is formed from or comprises the at least one second metal in the form of non-foamable full material. The at least one second region may in particular be formed as a solid, non-foamable metal layer, particularly as a cover layer, on at least part of the surface of the at least one first region. Preferably, on the surface of the first region, two second regions are each applied as a layer, in particular a cover layer, in the form of non-foamable full material, in other words two solid layers. Preferably, on the surface of the first region, two second regions are each applied as a layer in the form of a non-foamable full material, in other words two solid layers that are mutually separated by a zone of the first region in such a way that, during foaming, the first region can expand as a result of the associated volume increase due to the formation of the metal foam in this zone.

Preferably, the semi-finished product for the composite material has exactly one first region and exactly one second region. For particular applications, the semi-finished product preferably has exactly one first region and exactly two second regions. Particularly preferably, the semi-finished product for the composite material has exactly one first region and exactly two second regions, each of the two second regions forming a layer on the first region. Most preferably, the two second regions or layers are separated by a zone in which the first region or the semi-finished product can expand during foaming.

In a further embodiment of the method for producing a composite material, (a) the composite material comprises at least one first region, which is formed from the metal foam of the at least one first metal, and at least one second region, which is formed from at least one second metal in the form of non-foamable full material; and (b) the semi-finished product comprises at least one first region, which is formed from the foamable mixture, and at least one second region, which is formed from the at least one second metal in the form of non-foamable full material.

In a further embodiment, in the composite material the at least one first region is formed as a foamed core, and in the semi-finished product for producing this composite material the at least one first region is formed as a foamable core. This core is covered by the second region in the manner of a layer, in other words in the form of at least one cover layer. In this context, sandwich structures, in other words coated, plate-shaped structures, layer structures or layered structures having a planar, straight (uncurved) direction of spread, are possible. Sandwich structures of a first region, as a foamed core, and two second regions of non-foamable full material, which are formed as cover layers and arranged on two opposite outer faces of the core, are particularly preferred. The core and cover layer(s) thus describe planes of a straight (uncurved) direction of spread or are formed plate shaped. However, spherical layer structures having curved layers or planes are also possible, for example in a solid bar constructed in the manner of a layer or in a rod, a hose, a tube or a sausage. The spherical layer structure may be configured solid throughout, with a solid, bar-shaped core or with an innermost hollow core, in such a way that the foamable or foamed core has a tubular configuration.

Accordingly, the metal foams, composite materials, and semi-finished products therefor may according to the invention be of any desired shape, so long as an increase in volume or volume expansion of the at least one first region comprising the foamable mixture is provided in the semi-finished products. Thus, the semi-finished products may be formed plate-shaped, as round or polygonal bars and other, regularly or irregularly shaped bodies. In the case of the composite material, the semi-finished products may have a layer-like construction, but the at least one first and at least one second region may also be interconnected alongside one another in a different manner. Since the at least one second region consists of at least one solid, non-foamable second metal, and therefore expands during foaming of the at least one first region, the at least one second region must not fully cover the at least one first region; in other words, an "open" zone, which makes expansion of the at least one first region or of the foamable mixture possible during foaming, must be left in at least one first region. In the case of a hose-like, sausage-like or tube-like structure, "open" ends and/or at least one open inner duct are accordingly provided, at or in which the first region can expand during foaming.

If the foamable mixture or the semi-finished product is produced by powder metallurgy, the foamable mixture is in the form of powder comprising powder particles, at least at the start of the production process. The final semi-finished product may also contain the foamable mixture in powder form, but preferably the foamable mixture is in compressed form in the final semi-finished product, for example as a pellet. Compressing the powder leads to it solidifying, and can thus be sufficient for mechanical interconnection of the powder particles; in other words, the individual grains or particles of the powder (powder particles) are interconnected in part or in whole by diffusion and formation of (first) intermetallic phases within the mixture, instead of forming a loose powder. This (first) metallurgical connection has the advantage of a stable and compact foamable first region or core, which forms virtually no faults in the foam during foaming. In addition, as a result of the first metallurgical connection, a stable rolling ingot is produced; in other words, the deformability of the semi-finished product, in particular by rolling, bending, deep-drawing and/or hydroforming, is improved. Further, if a composite material is being produced, as a result of the first metallurgical connection the powder particles are connected in part to the at least one second region, in particular if it is in the form of a layer, for example in the form of a cover layer.

The powder of the at least one first metal consists of powder particles that may have a particle size of approximately 2 μm to approximately 250 μm, preferably of approximately 10 μm to approximately 150 μm. These particle sizes have the advantage that a particularly homogeneous mixture thus forms, in other words a particularly homogeneous foamable mixture, in such a way that later, during foaming, faults that would otherwise occur are prevented.

The foamable mixture comprises at least one first metal and at least one blowing agent. Preferably, the foamable mixture comprises exactly one first metal and at least one blowing agent. For particular applications, the foamable mixture preferably comprises exactly one first metal and exactly two blowing agents. Particularly preferably, the foamable mixture comprises exactly one first metal and exactly one blowing agent. The foamable mixture may further comprise additives. Preferably, however, the foamable mixture advantageously does not comprise any additives, since with one or more additives the structure of the foamable mixture and of the foamable core is disrupted in such a way that the foamed core subsequently obtained therefrom has faults such as inhomogeneities in the foam structure, excessively large pores or bubbles and/or open pores instead of closed pores. Particularly preferably, the foamable mixture merely contains exactly one first metal, exactly one blowing agent, optionally one or more derivatives of the blowing agent, and no further substances or additives. The foamable mixture may exclusively contain or consist of the aforementioned substances or constituents, rather than merely comprising them.

One or more derivatives of the blowing agent are conceivable if the blowing agent is selected from the group of metal hydrides; in this case, as the derivative(s), the blowing agent may additionally comprise at least one oxide and/or oxyhydride of the metal(s) of the respectively used metal hydrides. Oxides and/or oxyhydrides of this type occur during pretreatment of the blowing agent, and can improve the shelf life thereof as well as the response thereof during foaming, in other words the moment of release of the propellant gas, in such a way that the blowing agent(s) used do not release the propellant gas too early or indeed too late; excessively early or late release of the propellant gas can produce oversized cavities and thus faults in the metal foam.

Starting from a particular temperature, the gas evolution temperature of the blowing agent, the at least one blowing agent according to the invention releases, by way of the gas evolution or gas removal, a propellant gas, which is used for foaming the at least one first metal. If a metal hydride is used as the blowing agent, hydrogen ($H_2$) is released as the propellant gas. If a metal carbonate is used as the blowing agent, carbon dioxide ($CO_2$) is released as the propellant gas.

The at least one blowing agent according to the invention is selected from the blowing agents known to a person skilled in the art for the first metal in question. Preferably, exactly one blowing agent is used, but mixtures of blowing agents, in particular mixtures of two different blowing agents, may also be used. In particular, blowing agents selected from the group consisting of metal hydrides and metal carbonates are suitable for the metals explicitly mentioned herein.

As regards the selection of the blowing agent, it has surprisingly been found that the gas evolution temperature of the at least one blowing agent should advantageously be equal to the solidus temperature of the at least one first metal or below the solidus temperature of the at least one first metal, so as subsequently to achieve a closed-pore foam that is free of faults and a good result for the foaming of the core. However, the gas evolution temperature of the blowing agent should preferably not be more than approximately 90° C., particularly preferably not more than 50° C., below the solidus temperature of the at least one first metal.

When a composite material is produced and at least one second metal is used, the gas evolution temperature of the at least one blowing agent should also be less than the solidus temperature of the at least one second metal, since the at least one second metal must not enter its solidus range during the foaming of the at least one first metal, in other words must not begin to melt, so as to prevent mixing with the at least one first metal, as explained elsewhere herein. The gas evolution temperature of the at least one blowing agent is therefore preferably below, particularly preferably approximately 5° C. below, the solidus temperature of the at least one second metal.

The blowing agent according to the invention is selected as follows: for Mg, Al, Pb, Au, Zn or Ti as the main constituent of the first metal, the at least one blowing agent is preferably selected from the group consisting of metal hydrides and metal carbonates, more preferably selected from metal hydrides from the group consisting of $TiH_2$, $ZrH_2$, $HfH_2$, $MgH_2$, $CaH_2$, $SrH_2$, $LiBH_4$ and $LiAlH_4$; and carbonates of the second main group of the periodic system of the elements (alkaline earth metals), in other words in particular the group consisting of $BeCO_3$, $MgCO_3$, $CaCO_3$, $SrCO_3$ and $BaCO_3$.

For foaming Mg, Al, Pb, Au, Zn or Ti as the main constituent of the first metal, the at least one blowing agent is more preferably selected from the group consisting of $TiH_2$, $ZrH_2$, $MgCO_3$ and $CaCO_3$. The blowing agent is in particular a metal hydride. The metal hydride is preferably selected from the group consisting of $TiH_2$, $ZrH_2$, $HfH_2$, $MgH_2$, $CaH_2$, $SrH_2$, $LiBH_4$ and $LiAlH_4$. The at least one metal hydride is more preferably selected from the group consisting of $TiH_2$, $ZrH_2$, $HfH_2$, $LiBH_4$ and $LiAlH_4$, even more preferably selected from the group consisting of $TiH_2$, $ZrH_2$, $LiBH_4$ and $LiAlH_4$, even more preferably selected from the group consisting of $TiH_2$, $LiBH_4$ and $LiAlH_4$. Preferably, the metal hydride is also selected from the group consisting of $TiH_2$, $ZrH_2$ and $HfH_2$, more preferably consisting of $TiH_2$ and $ZrH_2$. For particular applications, a combination of two metal hydrides selected from the group consisting of $TiH_2$, $ZrH_2$ and $HfH_2$ is suitable, preferably the combination of $TiH_2$ and $ZrH_2$. For particular applications, in particular a combination of two metal hydrides where one blowing agent is selected from each of the two groups (a) $TiH_2$, $ZrH_2$ and $HfH_2$; and (b) $MgH_2$, $CaH_2$, $SrH_2$, $LiBH_4$ and $LiAlH_4$ is suitable as a blowing agent; of these, the combination of $TiH_2$ with a blowing agent selected from the group consisting of $MgH_2$, $CaH_2$, $SrH_2$, $LiBH_4$ and $LiAlH_4$ is preferred; the combination of $TiH_2$ with $LiBH_4$ or $LiAlH_4$ is particularly preferred. According to the invention, exactly one blowing agent is preferably used. If a metal hydride is used, in particular preferably exactly one metal hydride is used as a blowing agent, more preferably $TiH_2$, $ZrH_2$, $HfH_2$, $LiBH_4$ or $LiAlH_4$, even more preferably $TiH_2$, $LiBH_4$ or $LiAlH_4$, particularly preferably $TiH_2$. The blowing agent is in particular an alkaline earth metal carbonate, in particular selected from the group consisting of $MgCO_3$, $CaCO_3$, $SrCO_3$ and $BaCO_3$, preferably selected from the group consisting of $MgCO_3$, $CaCO_3$, $SrCO_3$ and $BaCO_3$, more preferably selected from the group consisting of $MgCO_3$, $CaCO_3$ and $SrCO_3$, particularly preferably selected from the group consisting of $MgCO_2$ and $CaCO_3$. For particular applications, when foaming Mg, Al, Pb, Au, Zn or Ti as the main constituent of the first metal, in particular a combination of a metal hydride with a metal carbonate where one blowing agent is selected from each of the two groups $TiH_2$, $ZrH_2$, $MgH_2$, $CaH_2$, $SrH_2$, $LiBH_4$ and $LiAlH_4$, and $MgCO_3$, $CaCO_3$, $SrCO_3$ and $BaCO_3$ is suitable.

For iron as the main constituent of the at least one first metal and steel as the at least one first metal, the at least one blowing agent is preferably selected from the group consisting of metal carbonates, more preferably selected from carbonates of the second main group of the periodic system of the elements (alkaline earth metals), in particular the group consisting of $MgCO_3$, $CaCO_3$, $SrCO_3$ and $BaCO_3$, even more preferably selected from the group consisting of $MgCO_3$, $CaCO_3$ and $SrCO_3$, particularly preferably selected from the group consisting of $MgCO_3$ and $SrCO_3$.

For the metal hydrides that according to the invention are in particular provided as a blowing agent, the gas evolution temperature is respectively as follows (gas evolution temperature specified in parentheses): $TiH_2$ (approximately 480° C.), $ZrH_2$ (approximately 640° C. to approximately 750° C.), $HfH_2$ (approximately 500° C. to approximately 750° C.), $MgH_2$ (approximately 415° C.), $CaH_2$ (approximately 475° C.), $SrH_2$ (approximately 510° C.), $LiBH_4$ (approximately 100° C.) and $LiAlH_4$ (approximately 250° C.). For the metal carbonates that according to the invention are in particular provided as a blowing agent, the gas evolution temperature is respectively as follows (gas evolution temperature specified in parentheses): $MgCO_3$ (approximately 600° C. to approximately 1300° C.), $CaCO_3$ (approximately 650° C. to approximately 700° C.), $SrCO_3$ (approximately 1290° C.) and $BaCO_3$ (approximately 1260° C. to approximately 1450° C.).

According to the invention, the metal hydride may additionally comprise as a blowing agent at least one oxide and/or oxyhydride of the metal(s) of one or more of the metal hydrides used in each case. The oxides and/or oxyhydrides occur during the pretreatment of the metal-hydride-containing blowing agent, and improve the shelf life thereof as well as the response thereof during foaming, in other words the moment of release of the propellant gas. The improvement in the response during foaming as regards the moment of release of the propellant as primarily involves a shift in the release of the propellant gas or gas evolution later, so as to prevent excessively early gas evolution and thus the formation of faults such as bubbles and holes instead of (closed) pores; this is achieved both by the aforementioned oxides and/or oxyhydrides and in that the at least one blowing agent, especially if one or more metal hydrides are used, is under high pressure in the matrix of the semi-finished product after the metal connection within the first region and optionally after the metal connection of the first region to the second region. As a method for pretreating the blowing agent, heat treatment in a furnace at a temperature of 500° C. over a period of approximately 5 h is suitable.

The oxide is in particular an oxide of formula $Ti_vO_w$, where v is approximately 1 to approximately 2 and w is approximately 1 to approximately 2. The oxyhydride is in particular an oxyhydride of formula $TiH_xO_y$, where x is approximately 1.82 to approximately 1.99 and y is approximately 0.1 to approximately 0.3. If the semi-finished product is produced by powder metallurgy, the oxide and/or oxyhydride of the blowing agent may form a layer on the grains of the powder of the blowing agent; the thickness of this layer may be approximately 10 nm to approximately 100 nm.

The quantity of the blowing agent, or the total quantity of all blowing agents if at least two different blowing agents are used, may be approximately 0.1 weight % (wt. %) to approximately 1.9 wt. %, preferably approximately 0.3 wt. % to approximately 1.9 wt. %, in each case in relation to the total quantity of the foamable mixture. The quantity of the oxide and/or oxyhydride may be approximately 0.01 wt. % to approximately 30 wt. %, in relation to the total quantity of the at least one blowing agent.

When a composite material is produced and at least one second metal is used, the at least one second metal may be selected as desired, so long as it is suitable for the solid permanent connection, typical in a composite material, to the other material component, in this case the metal foam.

Advantageously, the at least one first metal and the at least one second metal are not identical; in other words, the two metals differ at least in an alloy constituent, the mass proportion or weight proportion of at least one alloy constituent and/or the constitution (powder versus solid full material), in such a way that the solidus temperature of the at least one second metal is higher than the liquidus temperature of the at least one first metal. In particular, however, the solidus temperature of the at least one second metal is higher than the liquidus temperature of the foamable mixture.

As a result of the constitution of the at least one second metal as a (solid, non-foamable) full material, by contrast with the at least one first metal as a (compressed) powder, it generally has a different melting behavior therefrom; in other words, the same metal or the same metal alloy starts to melt later in time as a full material than in the form of powder, as a result of a higher melting enthalpy. However, full material may also only start to melt at a somewhat higher temperature than if it is present as (compressed) powder, especially if said powder is also additionally mixed with a blowing agent, since this lowers the melting point of the mixture of metal powder and blowing agent, in other words of the foamable mixture as a whole.

In the case of the composite material, it is advantageous for the solidus temperature of the at least one second metal to be higher than the liquidus temperature of the at least one first metal, in particular higher than the liquidus temperature of the foamable mixture. It is also advantageous if the at least one second metal starts to melt sufficiently much later in time (in other words late enough) than the at least one first metal, in such a way that the at least one second region, which is produced from the at least one second metal in solid, non-foamable form and which may be formed for example as a solid metal cover layer, does not melt or start to melt during foaming of the foamable mixture. It has been found that otherwise, during melting of the at least one layer, this deforms undesirably during the melting process, in particular under the pressure of the gas released from the blowing agent. If the at least one second metal stats to melt during the foaming of the at least one first metal, it mixes with the at least one first metal over the boundary layers, and destroys the foam or does not even allow it to form in the first place or is foamed itself, causing the foaming process to become completely uncontrollable.

The difference required for this purpose between the solidus temperature of the at least one second metal and the liquidus temperature of the at least one first metal is, on the one hand, dependent on the (chemical) nature of the metals or metal alloys that are selected for the at least one first metal and the at least one second metal and, on the other hand, determined by the melting behavior thereof. Advantageously, the at least one second metal has a solidus temperature that is at least 5° C. higher than the liquidus temperature of the foamable mixture. This higher solidus temperature and/or the temporally sufficiently late start of melting of the at least one second metal may be implemented according to the invention

- by way of the type or chemical nature of the metals used as the main constituent;
- by way of the form or constitution of the at least one second metal (as a solid full material by contrast with a powder form of the at least one first metal), in other words a form or constitution that brings about a higher solidus temperature and/or higher melting enthalpy (since metal in powder form melts earlier and has a lower solidus temperature than solid metal in the form of full material); and/or
- in that the at least one second metal has fewer alloy constituents than the at least one first metal and/or has at least one identical alloy constituent having a lower mass proportion in the alloy than (by comparison with) the at least one first metal (in other words, the mass proportion of the alloy constituent that is identical in the at least one first and at least one second metal is lower or smaller in the at least one second metal than in the at least one first metal).

If the same metal is used as a main constituent both for the at least one first region and for the at least one second region, at a content or in a quantity of at least approximately 80 wt. %, the different melting point, solidus temperature and/or liquidus temperature can be set accordingly using different alloy additives in the powder and the full material.

Preferably, the solidus temperature of the at least one second metal is at least 5° C. higher than the liquidus temperature of the at least one first metal. Depending on the metal or metal alloy, the solidus temperature of the at least one second metal is more preferably at least approximately 6° C., even more preferably at least approximately 7° C., even more preferably at least approximately 8° C., even more preferably at least approximately 9° C., even more preferably at least approximately 10° C., even more preferably at least approximately 11° C., even more preferably at least approximately 12° C., even more preferably at least approximately 13° C., even more preferably at least approximately 14° C., even more preferably at least approximately 15° C., even more preferably at least approximately 16° C., even more preferably at least approximately 17° C., even more preferably at least approximately 18° C., even more preferably at least approximately 19° C. and even more preferably at least approximately 20° C. higher than the liquidus temperature of the at least one first metal. In each case, by way of the difference between the solidus temperature of the at least one second metal and the liquidus temperature of the at least one first metal, it should be ensured that, during the foaming process, the at least one second region, for example as a cover layer applied to the core, consisting of the at least one second metal, does not start to soften or melt and does not melt to such an extent that the propellant gas formation and/or expansion leads to undesirable bulges, dents, cracks, holes and similar faults in the at least one second region and/or that the at least one second region fuses or mixes in part or in whole with the at least one first region. Typically, the solidus temperature of the at least one second metal should be at least approximately 5° C. higher, preferably approximately 10° C. higher and particularly preferably approximately 15° C. higher than the liquidus temperature of the at least one first metal; in particular cases, the solidus temperature of the at least one second metal is at least approximately 20° C. higher than the liquidus temperature of the at least one first metal. In particular, it has surprisingly been found that a solidus temperature of the at least one second metal that is approximately 15° C. higher than the liquidus temperature of the at least one first metal generally provides a good compromise between the strength of the metal foam structure and of the full material, on the one hand, and the quality of the composite structure on the other hand, in other words a clear phase boundary between the metal foam and the full material and no fusing of metal foam and full material. Most preferably, the solidus temperature of the at least one second metal is higher than the liquidus temperature of the foamable mixture by the temperature respectively specified above.

In a preferred embodiment, the at least one first and second metal are not identical. For this purpose, the at least one second metal has fewer alloy constituents than the at least one first metal; the at least one second metal alternatively or additionally has at least one identical alloy constituent at a lower mass proportion in the alloy than the at least one first metal; as a result, the solidus temperature specified herein of the at least one second metal, which is higher than the liquidus temperature of the at least one first metal, can be achieved.

Preferably, according to the invention, the composite material and the semi-finished product for the production thereof contain exactly one second metal as a (solid, non-foamable) full material. In this context, full material is understood to be solid metal that is not foamed, in other words has no pores, and is also not in powder form. In this context, the metal may also be a metal alloy. The full material within the meaning of this invention is not foamable, by contrast with the foamable mixture according to the invention. Preferably, the at least one second metal has the main component Mg (magnesium), Al (aluminum), Pb (lead), Au (gold), Zn (zinc), Ti (titanium), Fe (iron) or Pt (platinum) in a quantity of at least 80 wt. %, in relation to the quantity of the at least one second metal. For this purpose, in addition, the at least one second metal may be selected from those pure metals and alloys defined herein for the at least one first metal. Preferably, the at least one first metal and the at least one second metal have the same main constituent Mg, Al, Pb, Au, Zn, Ti or Fe. If the at least one second metal has aluminum as the main constituent, it is in particular selected from the group consisting of pure aluminum and high-strength aluminum alloys selected from the group consisting of aluminum-magnesium alloys (5000 series), aluminum-magnesium-silicon alloys (6000 series) and aluminum zinc alloys (7000 series).

The at least one second metal may be aluminum or pure aluminum (at least 99 wt. % aluminum), aluminum being preferred in which the content of aluminum is approximately 85 wt. % to approximately 99 wt. %, particularly preferably approximately 98 wt. %, in relation to the at least one second metal. Moreover, the at least one second metal may be a high-strength aluminum alloy. The high-strength aluminum alloy may be selected from the group consisting of aluminum-magnesium alloys (5000 series), aluminum-magnesium-silicon alloys (6000 series) and aluminum-zinc alloys (7000 series). The at least one second metal may in particular be an aluminum-magnesium alloy (5000 series). The at least one second metal may in particular be an aluminum-magnesium-silicon alloy (6000 series), preferably Al 6082 (AlSi1MgMn). Finally, the at least one second metal may in particular be an aluminum-zinc alloy (7000 series).

Suitable combinations of first and second metal are, by way of example, without being limited hereto, alloys having the following metals as the main constituent, in other words in a quantity of at least approximately 80 wt. %, in relation to the respective first and second metal, suitable blowing agents additionally being specified by way of example, without being limited hereto:

| Main constituent of the first metal (alloy) | Blowing agent | Main constituent of the second metal (alloy) |
|---|---|---|
| Al | $TiH_2$ | Al or Fe[1] |
| Zn | $MgH_2$ | Al or Fe[1] |
| Pb | $ZrH_2$ | Al or Fe[1] |
| Mg | $TiH_2$ | Al or Fe[1] |
| Fe | $MgCO_3$ | Ti |
| Ti | $SrCO_3$ | Ti |
| Au | $SrCO_3$ | Pt or Ti |

[1]For iron (Fe) as the main constituent, steel may be used as the alloy.

The temporal order or sequence of the method steps according to the invention preferably corresponds to the numbering with Roman numerals as set out in embodiment (1); in other words, preferably, first step (I) takes place first, then step (II) and finally step (III). According to the invention, the heat input into the semi-finished product, during heating in step (III) and optionally preheating in a step (IV) described below, takes place into the semi-finished product from the outside, in other words via the outer surface of the semi-finished product or part of the outer surface of the semi-finished product. In step (III), the heat input into the semi-finished product takes place, while heating in a heatable bath comprising a liquid (heatable liquid bath), into the semi-finished product from the outside by means of the liquid, in other words from the liquid via the outer surface of the semi-finished product or part of the outer surface of the semi-finished product. Preferably, in each case there is at least complete wetting or else complete contact of those parts of the outer surface of the semi-finished product that are also part of the (at least one first) region to be foamed of the semi-finished product or behind which the (at least one first) region to be foamed of the semi-finished product is (directly) located, with the liquid of the heatable bath. Accordingly, in step (II) the semi-finished product is preferably submerged in the heatable, preferably already heated bath, in such a way that there is at least complete wetting of the aforementioned parts of the outer surface of the semi-finished product with the liquid of the heatable bath.

The heating in step (III) of the method preferably also takes place to a foaming temperature that, within the foamable mixture, is (a) at least as high as the gas evolution temperature of the at least one blowing agent and/or (b) at least as high as the solidus temperature of the foamable mixture. The foaming temperature is a temperature at which the at least one first metal is in a foamable state and the blowing agent decomposes and thus gives off a blowing agent that foams the at least one first metal. The at least one first metal is in a foamable state when it starts to melt (at its solidus temperature) or is melted in part or in whole. The heat is supplied in such a way (sufficiently rapidly) that the rest of the at least one first metal is melted and foamable before the blowing agent has completely decomposed. If a composite material is produced, the heating in step (III) preferably takes place to a foaming temperature that, within the foamable mixture, is less than the solidus temperature of the at least one second metal. This has the advantage that no mixing of the metals of the at least one first and second region can take place, and during foaming the semi-finished product maintains its original structure, with the exception of the increase in volume due to the foaming process, and is not twisted.

The foaming temperature in step (III) of the method according to the invention is the temperature at which the foamable mixture foams and forms the metal foam. The foaming temperature should be greater than or equal to the gas evolution temperature of the at least one blowing agent, at least as high as the solidus temperature of the at least one first metal (more exactly, taking into account an, admittedly generally small, reduction in melting point due to the mixing with the at least one blowing agent and optionally an additive: at least as high as the solidus temperature of the foamable mixture), and less than the solidus temperature of the at least one second metal, so as to achieve as homogeneous a metal foam as possible and preserve the character of the composite material, in other words so as to prevent melting of the two materials that goes beyond that required for surface connection between the metal foam and the metal full material.

The method according to the invention may additionally comprise the step of (IV) preheating by heating the semi-finished product of step (I) to a temperature approximately 50° C. to approximately 180° C., preferably to approximately 100° C., below the foaming temperature, step (IV) being performed temporally before step (II) and/or step (III). Preferably, step (IV) takes place temporally before step (II), which in turn takes place temporally before step (III). This procedure has the advantage that the liquid bath used for the foaming can be used more efficiently for the actual foaming process, in other words at a higher throughput per unit time, because the (remaining) required heat supply into the semi-finished product that is still to take place in this liquid bath and that is required for the foaming process ends up being less than if the semi-finished product were heated to the foaming temperature in the liquid bath starting from the ambient or room temperature, for example. As a result, for the preheating, one or more other heatable liquid baths, or simpler heating sources that are less well-suited to foaming metal and that do not comprise a liquid bath according to the invention, such as electric resistance furnaces, may be used. Preferably, the submersion in step (II) takes place in a warmed or heated bath, in such a way that the heating takes place immediately in step (III). The prewarming/preheating may take place for one or easily even more parts simultaneously, and over relatively long periods of several hours, preferably over periods of approximately 5 min. to approximately 8 h, more preferably over periods of approximately 10 min. to approximately 6 h.

The heating in step (III) of the method according to the invention may take place using a controlled heating rate, so as to match the moment of a propellant gas development sufficient for foaming the at least one first metal to the moment of reaching a foamable state of the at least one first metal, such as the solidus temperature thereof. The heat supply should take place in such a way that a sufficient propellant gas development for foaming the at least one first metal and an approximate maximum of the propellant gas development occur when the at least one first metal has reached the foamable state thereof, for example the solidus temperature thereof. Preferably, for the metals and blowing agents provided according to the invention, the heating in step (III) of the method takes place at a heating rate of approximately 0.5 K/s to approximately 50 K/s, particularly preferably of approximately 5 K/s to approximately 20 K/s.

The submersion of the semi-finished product in the heatable liquid bath preferably takes place in such a way that a heat input into the regions to be foamed or the at least one first region takes place on as short a path as possible. For this purpose, in each case there is at least complete wetting or else contacting of those parts of the outer surface of the semi-finished product that are also part of the (at least one first) region to be foamed of the semi-finished product, or behind which the (at least one first) region to be foamed of the semi-finished product is (directly) located, with the liquid of the heatable bath. Particularly preferably, the semi-finished product is completely submerged in the heatable liquid bath. As a result of the aforementioned procedure when the semi-finished product is submerged, the homogeneity of the heat input is improved, since it thus takes place directly, in other words through direct heat introduction and transmission from the liquid to the semi-finished product, excluding the heat losses that are possible in other methods during the transmission by radiation. The direct heat conduction and transmission is made possible by the direct contact between the liquid and the semi-finished product. This also further improves the homogeneity of the metal foam formed. In particular, the formation of faults in the foam and, in the case of the composite material, also at the boundary surfaces between the at least one first and at least one second region, in other words between the foam and the non-foamable, solid full material, is thus reduced; this applies particularly if the at least one second region in the composite material is formed as a layer or cover layer on the at least one first region, and applies more particularly if the composite material comprises exactly one first region and exactly two second regions and each of the two second regions is formed as a layer or cover layer on the exactly one first region, and applies most particularly if in these cases the first region is formed as a core or core layer in the composite material.

For the liquid of the heatable bath, substances or substance mixtures are considered that can be heated at least to the respectively required foaming temperature without boiling or evaporating to a significant extent. Moreover, the liquid must neither (chemically) attack the final metal foam or the final composite material nor otherwise detract from or damage the desired external and internal constitution thereof. Surprisingly, it has been found that a molten salt, which is selected from salts, in particular inorganic salts, or solid particles, in particular sand or aluminum oxide granulate, can meet these requirements. In this context, the salt is not in solution in a chemical compound present as a liquid at room temperature, in particular not in an aqueous solution. It is possible to use a mixture of two or more salts. For a mixture of at least two salts, at least one salt may be dissolved in the melt of the other salt(s). Thus, the liquid of the heatable bath preferably comprises at least one molten salt, particularly preferably exactly one molten salt. The liquid of the heatable bath preferably comprises at least one molten inorganic salt, particularly preferably exactly one molten inorganic salt, preferably sodium chloride or potassium chloride. The (entire) liquid of the heatable bath may exclusively contain or consist of the aforementioned substances or components, rather than merely comprising them. The term "liquid" within the meaning of the present invention thus also comprises in particular molten salts and solid particles. Solid particle baths comprise solid particles in a mixture with at least one gas and/or air, in particular nitrogen or helium as a gas, including in a further mixture with air, and within the meaning of the present invention are preferably produced by a fluidized bed furnace. Solid particles are flowed through by the at least one gas and/or air in such a way that they are set in movement and behave like a liquid, or have properties that are equivalent to a liquid for the present invention. This is also the case for molten salt within the meaning of the present invention. The particle size of the useable solid particles in the heatable bath is preferably in a range of approximately 10 μm to approximately 200 μmm, more preferably in a range of approximately 80 μm to approximately 150 μm. Preferably, within the meaning of the present invention, sands or aluminum oxide, in particular in the form of a granulate, are used.

Particularly preferably, if solid particles are used, preheating/prewarming is performed in step (IV). In this context, the semi-finished product can be submerged and preheated in a solid particle bath, for example of sand, in particular to temperatures in a region of approximately 430° C. to approximately 520° C., preferably to temperatures in a range of approximately 450° C. to approximately 500° C. In this context, one or easily even more parts simultaneously may be heated over relatively long periods of several hours, preferably over periods of approximately 5 min. to approximately 8 h, more preferably over periods of approximately 10 min. to approximately 6 h. Subsequently, in step (II), the semi-finished product is preferably submerged in a solid particle bath, in particular in a fluidized bed furnace, in particular of aluminum oxide in the form of a granulate, the bath preferably having a temperature in a range of approximately 570° C. to approximately 630° C., more preferably a temperature in a range of approximately 580° C. to approximately 610° C. The heating according to step (III) thus takes place immediately. The dwell time in this solid particle bath is preferably approximately 1 min. to approximately 10 min., more preferably approximately 1.5 min. to approximately 6 min. Subsequently, the foamed semi-finished product is preferably removed and supplied to quenching, for example in the form of a solid particle bath, in particular of sand, at preferably a temperature in a range of approximately 10° C. to approximately 40° C. The dwell time for the quenching is preferably in a range of approximately 30 s to approximately 10 min., preferably in a range of approximately 1 min. to approximately 3 min. Subsequently, the foamed semi-finished product, for example in the form of a composite material as described above, can be taken out warm. Steps (I) to (IV) may also be performed in a continuously running system, so as to increase the production rate. Preheating/prewarming and foaming may also take place in the same bath.

For a sufficiently high heat transmission to the semi-finished product, in particular for better control of particular heating rates, in particular if the heating rates are high, a correspondingly high (specific) heat capacity and/or thermal conductivity of the liquid of the heatable bath are desirable. A high (specific) heat capacity and/or thermal conductivity of the liquid of the heatable bath thus surprisingly makes it possible to form a particularly homogeneous metal foam, in other words one with a narrow size distribution of the pore sizes. Moreover, the foaming process can take place more rapidly in this way. For this purpose, the liquid or the molten salt of the heatable bath preferably has (a) a specific heat capacity of approximately 1000 J/(kg·K) to approximately 2000 (kg·K), and/or (b) a thermal conductivity of approximately 0.1 W/(m·K) to approximately 1 W/(m·K).

For a suitable selection of the density of the liquid, in particular of the molten salt or the solid particle bath, by comparison with the density of the first metal or the foam thereof and if applicable the second metal, or the (final) metal foam or composite material the reaching of the end point of step (III) can be signified by floating of the metal foam or composite material.

To achieve a good mechanical load capacity, in particular good strength and/or torsional rigidity of the metal foam or composite material comprising a metal foam, the metal foam, including as a part or region of the composite material, is formed closed-pore. The closed, spherical pores that are thus sought make possible optimum load transmission via the cell walls, which are as intact as possible, enclosing the pores, and thus contribute significantly to the strength of the metal foam and thus also of a composite material comprising a metal foam. A metal foam is closed-pore if the individual gas volumes therein, in particular two mutually adjacent gas volumes, are mutually separated by a separating solid phase (wall) or at most interconnected by small openings (cracks, holes) due to manufacture, the cross section of which is in each case small relative to the cross section of the solid phase (wall) that separates the two gas volumes in each case. The substantially closed-pore metal foam is distinguished in that the individual gas volumes are interconnected at most by small openings (cracks, holes) due to manufacture, the cross section of which, however, is small relative to the cross section of the solid phase separating the volumes.

The porosity of the metal foam thus formed is approximately 60% to approximately 92%, preferably approximately 80% to approximately 92%, particularly preferably approximately 89.3%. The density of the non-foamed full material may be approximately 90% to approximately 100% of the density of the primary material. The density of the metal foam formed in step (III) may reach approximately 0.2 $g/cm^3$ to approximately 0.5 $g/cm^3$ for aluminum foam or, depending on the density of the non-foamed full material, a porosity of approximately 60% to approximately 92%.

The method according to the invention may additionally comprise the step of (V) shaping the semi-finished product provided in step (I) into a shaped part, the shaped part thus obtained being heated instead of the semi-finished product in step (III) and/or (IV). The semi-finished product may be shaped by methods known to a person skilled in the art for this purpose.

According to the invention, however, the shaping preferably takes place by a method selected from the group consisting of bending, deep-drawing, hydroforming and hot-pressing.

The present invention finally comprises a composite material that can be obtained by the method according to the invention a component comprising a composite material.

The term "component" denotes a part or production part that can be used for a specific application or a specific use, alone or together with other components, for example for a device, a machine a (watercraft or aircraft) vehicle, a building, a piece of furniture or another end product. For this purpose, the component may have a particular shaping, for example required for cooperation with other components, for example in an exact fit. Shaping of this type may advantageously already be carried out by the additional method step described herein of shaping (step (V)) on the non-foamed (in other words foamable) semi-finished product, which can be deformed more easily than the metal foam or composite material.

The invention is explained in greater detail with reference to FIG. 1.

FIG. 1 shows a composite material according to the invention in cross section as a metal foam sandwich that has been produced in a salt bath in accordance with Example 1.

Example 1

A semi-finished product, consisting of two solid cover layers and a foamable core that contained a foamable mixture, the metal or the metal components of which in each case consisted of an aluminum alloy as set out in the table below, was dipped in a salt bath at a temperature of 550° C. to 650° C. and foamed therein. As a result of the high heat capacity and thermal conductivity of the salt and the excellent thermal contact in the salt bath over the entire surface of the semi-finished product by comparison with conventional heating methods when aluminum is foamed, the semi-finished product was brought very homogeneously to the foaming temperature of 550° C. to 650° C.; in other words, all regions of the semi-finished product reached the sought foaming temperature simultaneously or virtually simultaneously. After the solidus temperature was exceeded, the foamable core started to expand uniformly and formed a good pore distribution (see FIG. 1). In this context, the heating rates of the foaming were between 0.5 K/s and 50 K/s, irrespective of the material thickness. As a result of the foaming, the density of the semi-finished product fell below the density of the salt bath, causing the metal foam sandwich to swell up and the end of the foaming process to be easily detectable.

The method was accordingly also carried out using a semi-finished product consisting only of a pressed foamable mixture without cover layers.

| Example | Alloy in the foamable mixture | Blowing agent[1] in the foamable mixture | Alloy of the cover layers |
|---|---|---|---|
| 1.1 | AlSi8Mg4 | $TiH_2$ (1.0 wt. %) | Al 6082 |
| 1.2 | AlSi8Mg4 | $TiH_2$ (0.5 wt. %) | Al 5754 |
| 1.3 | AlSi8Mg4 | $TiH_2$ (0.6 wt. %) | Al 5005 |
| 1.4 | AlSi8Mg4 | $TiH_2$ (0.6 wt. %) | Al 6016 |
| 1.5 | AlSi7 | $TiH_2$ (1.2 wt. %) | Al 3103 |
| 1.6 | AlSi6Mg7.5 | $TiH_2$ (0.8 wt. %) | Al 6060 |

-continued

| Example | Alloy in the foamable mixture | Blowing agent[1] in the foamable mixture | Alloy of the cover layers |
|---|---|---|---|
| 1.7 | AlSi4Mg7.5 | $TiH_2$ (0.6 wt. %) | without cover layers |
| 1.8 | AlSi6Mg3 | $TiH_2$ (0.6 wt. %) | without cover layers |

[1]The specification of the quantity of blowing agent in % by weight (wt. %) is based on the total quantity of the foamable mixture. The same method was also carried out with the following blowing agents instead of TiH2 in the amounts set out above: $ZrH_2$, $HfH_2$, $MgH_2$, $CaH_2$, $SrH_2$, $LiBH_4$ and $LiAlH_4$, as well as each of the combinations of $TiH_2$ with $LiBH_4$ and $TiH_2$ with $LiAlH_4$.

Example 2

The method was carried out in accordance with Example 1, but with the salt bath having a temperature of 400° C. to 500° C. and the foam temperature being 380° C. to 420° C.

| Example | Alloy in the foamable mixture | Blowing agent[1] in the foamable mixture | Alloy of the cover layers |
|---|---|---|---|
| 2.1 | ZnTi2 | $MgH_2$ (0.5 wt. %) | Al 6082 |
| 2.2 | ZnTi2 | $MgH_2$ (0.6 wt. %) | Al 6082 |
| 2.3 | ZnTi2 | $MgH_2$ (0.8 wt. %) | Al 6082 |
| 2.4 | ZnTi2 | $MgH_2$ (1.0 wt. %) | Al 6082 |
| 2.5 | ZnTi2 | $MgH_2$ (1.2 wt. %) | Al 6082 |
| 2.6 | ZnTi2 | $MgH_2$ (0.6 wt. %) | without cover layers |
| 2.7 | ZnCu8 | $MgH_2$ (0.6 wt. %) | without cover layers |

[1]The specification of the quantity of blowing agent in % by weight (wt. %) is based on the total quantity of the foamable mixture. The same method was also carried out with $TiH_2$ as a blowing agent instead of $MgH_2$ in the amounts set out above.

Example 3

The method was carried out in accordance with Example 1, but with the salt bath having a temperature of 300° C. to 400° C. and the foam temperature being 310° C. to 380° C.

| Example | Alloy in the foamable mixture | Blowing agent[1] in the foamable mixture | Alloy of the cover layers |
|---|---|---|---|
| 3.1 | PbCu1 | $ZrH_2$ (0.5 wt. %) | Al 6082 |
| 3.2 | PbCu1 | $ZrH_2$ (0.6 wt. %) | Al 6082 |
| 3.3 | PbCu1 | $ZrH_2$ (0.8 wt. %) | Al 6082 |
| 3.4 | PbCu1 | $ZrH_2$ (1.0 wt. %) | Al 6082 |
| 3.5 | PbCu1 | $ZrH_2$ (1.2 wt. %) | Al 6082 |
| 3.6 | PbCu1 | $ZrH_2$ (0.8 wt. %) | without cover layers |
| 3.7 | PbZn5 | $ZrH_2$ (0.8 wt. %) | without cover layers |

[1]The specification of the quantity of blowing agent in % by weight (wt. %) is based on the total quantity of the foamable mixture. The same method was also carried out with $TiH_2$ as a blowing agent instead of $ZrH_2$ in the amounts set out above.

Example 4

The method was carried out in accordance with Example 1, but with the salt bath having a temperature of 550° C. to 650° C. and the foam temperature being 580° C. to 630° C.

| Example | Alloy in the foamable mixture | Blowing agent[1] in the foamable mixture | Alloy of the cover layers |
|---|---|---|---|
| 4.1 | AZ 31 (Mg96Al3Zn) | $TiH_2$ (0.5 wt. %) | Al 6082 |
| 4.2 | AZ 31 (Mg96Al3Zn) | $TiH_2$ (0.6 wt. %) | Al 6082 |
| 4.3 | AZ 31 (Mg96Al3Zn) | $TiH_2$ (0.8 wt. %) | Al 6082 |
| 4.4 | AZ 31 (Mg96Al3Zn) | $TiH_2$ (1.0 wt. %) | Al 6082 |
| 4.5 | AZ 31 (Mg96Al3Zn) | $TiH_2$ (1.2 wt. %) | Al 6082 |

-continued

| Example | Alloy in the foamable mixture | Blowing agent[1] in the foamable mixture | Alloy of the cover layers |
|---|---|---|---|
| 4.6 | AZ 31 (Mg96Al3Zn) | $TiH_2$ (0.6 wt. %) | without cover layers |
| 4.7 | AZ 91 (Mg90Al9Zn) | $TiH_2$ (0.6 wt. %) | without cover layers |

[1]The specification of the quantity of blowing agent in % by weight (wt. %) is based on the total quantity of the foamable mixture.

Example 5

The method was carried out in accordance with Example 1, but with the salt bath having a temperature of 1200° C. to 1450° C. and the foam temperature being 1380° C. to 1420° C.

| Example | Alloy in the foamable mixture | Blowing agent[1] in the foamable mixture | Alloy of the cover layers |
|---|---|---|---|
| 5.1 | Steel 1.4301 | $MgCO_3$ (0.5 wt. %) | TiAl2 |
| 5.2 | Steel 1.4301 | $MgCO_3$ (0.6 wt. %) | TiAl2 |
| 5.3 | Steel 1.4301 | $MgCO_3$ (0.8 wt. %) | TiAl2 |
| 5.4 | Steel 1.4301 | $MgCO_3$ (1.0 wt. %) | TiAl2 |
| 5.5 | Steel 1.4301 | $MgCO_3$ (1.2 wt. %) | TiAl2 |
| 5.6 | Steel 1.4301 | $MgCO_3$ (1.0 wt. %) | without cover layers |
| 5.7 | ST37 | $MgCO_3$ (1.0 wt. %) | without cover layers |

[1]The specification of the quantity of blowing agent in % by weight (wt. %) is based on the total quantity of the foamable mixture.

Example 6

The method was carried out in accordance with Example 1, but with the salt bath having a temperature of 1300° C. to 1650° C. and the foam temperature being 1500° C. to 1680° C.

| Example | Alloy in the foamable mixture | Blowing agent[1] in the foamable mixture | Alloy of the cover layers |
|---|---|---|---|
| 6.1 | Ti—6Al—2Sn—4Zr—6Mo | $SrCO_3$ (0.5 wt. %) | Ti—5Al—2Sn—2Zr—4Mo—4Cr or Ti |
| 6.2 | Ti—6Al—2Sn—4Zr—6Mo | $SrCO_3$ (0.6 wt. %) | Ti—5Al—2Sn—2Zr—4Mo—4Cr or Ti |
| 6.3 | Ti—6Al—2Sn—4Zr—6Mo | $SrCO_3$ (0.8 wt. %) | Ti—5Al—2Sn—2Zr—4Mo—4Cr or Ti |
| 6.4 | Ti—6Al—2Sn—4Zr—6Mo | $SrCO_3$ (1.0 wt. %) | Ti—5Al—2Sn—2Zr—4Mo—4Cr or Ti |
| 6.5 | Ti—6Al—2Sn—4Zr—6Mo | $SrCO_3$ (1.2 wt. %) | Ti—5Al—2Sn—2Zr—4Mo—4Cr or Ti |
| 6.6 | Ti—6Al—2Sn—4Zr—6Mo | $SrCO_3$ (1.0 wt. %) | without cover layers |
| 6.7 | Ti—5Al—2Sn—2Zr—4Mo—4Cr | $SrCO_3$ (1.0 wt. %) | without cover layers |

[1]The specification of the quantity of blowing agent in % by weight (wt. %) is based on the total quantity of the foamable mixture.

Example 7

The method was carried out in accordance with Example 1, but with the salt bath having a temperature of 900° C. to 1150° C. and the foam temperature being 980° C. to 1100° C.

| Example | Alloy in the foamable mixture | Blowing agent[1] in the foamable mixture | Alloy of the cover layers |
|---|---|---|---|
| 7.1 | 750 Au | $SrCO_3$ (0.5 wt. %) | Pt |
| 7.2 | 750 Au | $SrCO_3$ (0.6 wt. %) | Pt |
| 7.3 | 750 Au | $SrCO_3$ (0.8 wt. %) | Pt or Ti |
| 7.4 | 750 Au | $SrCO_3$ (1.0 wt. %) | Pt or Ti |
| 7.5 | 750 Au | $SrCO_3$ (1.2 wt. %) | Pt or Ti |
| 7.6 | 750 Au | $SrCO_3$ (1.0 wt. %) | without cover layers |
| 7.7 | 585 Au | $SrCO_3$ (1.0 wt. %) | without cover layers |

[1]The specification of the quantity of blowing agent in % by weight (wt. %) is based on the total quantity of the foamable mixture.

Example 8

The method was carried out in accordance with Example 1, but with, instead of a salt bath, a fluidized bed furnace being used having aluminum oxide granulate as a solid particle bath having a particle size in a range of approximately 80 μm to approximately 100 μm. The temperature for the heating after step (III) was 600° C. and the dwell time in the fluidized bed furnace was 3 min. AlSi8Mg4 was used as the alloy and 0.8 wt. % $TiH_2$, in relation to the total quantity of the foamable mixture, was used as the blowing agent. Before foaming, the semi-finished product was prewarmed/heated over 15 min. in a sand bath at 500° C. The foaming took place by submerging in the heated solid particle bath. The bath for prewarming/preheating and for foaming may also be identical. The obtained composite material was formed closed-pore and had a highly homogeneous metal foam between the two cover layers.

The invention claimed is:

1. Method for producing a metal foam of at least one first metal that contains a main constituent of Mg, Al, Pb, Au, Zn, Ti or Fe in a quantity of at least approximately 80 wt. % in relation to the quantity of the at least one first metal, said method comprising the following steps:

(I) providing a semi-finished product comprising a foamable mixture that comprises the at least one first metal and at least one blowing agent, (II) submerging the semi-finished product in a heatable bath comprising a liquid wherein the liquid of the heatable bath comprises at least one molten salt or solid particle, and (III) heating the semi-finished product in the bath in order to foam the foamable mixture by removing gas from the at least one blowing agent for forming the metal foam.

2. Method according to claim 1, wherein the semi-finished product comprises at least one first region, which is formed from the foamable mixture, and at least one second region, which is formed from at least one second metal in the form of non-foamable full material, for producing a composite material, the composite material comprising at least one first region, which is formed from the metal foam of the at least one first metal, and at least one second region, which is formed from at least one second metal in the form of non-foamable full material.

3. Method according to claim 2, wherein the at least one second metal contains a main constituent of Mg, Al, Pb, Au, Zn, Ti or Fe in a quantity of at least approximately 80 wt. % in relation to the quantity of the at least one second metal.

4. Method according to claim 3, wherein the at least one first metal and the at least one second metal have the same main constituent Mg, Al, Pb, Au, Zn, Ti or Fe.

5. Method according to claim 2, wherein the at least one second metal (a) has a solidus temperature that is at least 5° C. higher than the liquidus temperature of the foamable mixture; and/or (b) has fewer alloy constituents than the at least one first metal or has at least one identical alloy constituent having a lower mass proportion in the alloy than for the at least one first metal.

6. Method according to claim 2, wherein the at least one second region is formed as a layer on at least part of the surface of the at least one first region.

7. Method according to claim 6, wherein (a) in the composite material the at least one first region is formed as a foamed core, and (b) in the semi-finished product for producing this composite material the at least one first region is formed as a foamable core.

8. Method according to claim 2, wherein the gas evolution temperature of the at least one blowing agent is below the solidus temperature of the at least one second metal.

9. Method according to claim 2, wherein the heating in step (III) takes place to a foaming temperature that, within the foamable mixture, is less than the solidus temperature of the at least one second metal.

10. Method according to 1, wherein the gas evolution temperature of the at least one blowing agent (a) is equal to the solidus temperature of the at least one first metal or (b) below the solidus temperature of the at least one first metal, but not more than approximately 90° C. below the solidus temperature of the at least one first metal.

11. Method according to claim 1, wherein the at least one blowing agent is selected from the group consisting of metal hydrides and metal carbonates.

12. Method according to claim 1, wherein the heating in step (III) of the method also takes place to a foaming temperature that, within the foamable mixture, is (a) at least as high as the gas evolution temperature of the at least one blowing agent and/or (b) at least as high as the solidus temperature of the foamable mixture.

13. Method according to claim 1, additionally comprising the step of (IV) preheating by heating the semi-finished product of step (I) to a temperature approximately 50° C. to approximately 100° C. below the foaming temperature, step (IV) being performed temporally before step (II) and/or step (III).

14. Method according to claim 1, wherein the heating in step (III) takes place at a heating rate of approximately 0.5 K/s to approximately 50 K/s.

15. Method according to claim 1, wherein the liquid of the heatable bath has (a) a specific heat capacity of approximately 1000 J/(kg·K) to approximately 2000 J/(kg·K), and/or (b) a thermal conductivity of approximately 0.1 W/(m·K) to approximately 1 W/(m·K).

16. Method according to claim 1, wherein the solid particles have a particle size in a range of approximately 10 μm to approximately 200 μm.

17. Method according to claim 1, wherein solid particles of aluminum oxide are used as the solid particles.

18. Method according to claim 1, wherein, while using solid particles, a fluidized bed furnace is used.

19. Method according to claim 1, wherein in step (III) a substantially closed-pore metal foam is formed.

20. Method according to claim 1, wherein the porosity of the metal foam formed in step (III) is approximately 60% to approximately 92%.

21. Method according to claim 1, additionally comprising the step of shaping the semi-finished product provided in step (I) into a shaped part, the shaped part thus obtained being heated instead of the semi-finished product in step (III).

* * * * *